US005642095A

United States Patent [19]

Cook

[11] Patent Number: 5,642,095

[45] Date of Patent: Jun. 24, 1997

[54] ALARM FOR A CARD SHAPED OBJECT

[75] Inventor: Russel P. Cook, Wellesley, Mass.

[73] Assignee: Wellesley Research Associates, Inc., Wellesley, Mass.

[21] Appl. No.: 544,484

[22] Filed: Oct. 18, 1995

[51] Int. Cl.[6] ..... G08B 13/14

[52] U.S. Cl. ..... 340/568; 340/573; 340/539; 150/102; 150/134

[58] Field of Search ..... 340/568, 573, 340/539, 572, 871; 150/102, 134

[56] References Cited

U.S. PATENT DOCUMENTS

| | | | |
|---|---|---|---|
| 3,959,789 | 5/1976 | McGahee | 340/568 |
| 4,480,250 | 10/1984 | McNeely | 340/568 |
| 4,652,865 | 3/1987 | Maharshak | 340/568 |
| 4,674,628 | 6/1987 | Prinsloo et al. | 206/38.1 |
| 4,692,745 | 9/1987 | Simanowitz | 340/568 |
| 4,717,908 | 1/1988 | Phillips et al. | 340/568 |
| 4,719,453 | 1/1988 | Beck et al. | 340/568 |
| 4,890,094 | 12/1989 | Kopel | 340/571 |
| 4,916,434 | 4/1990 | McNeely | 340/568 |
| 5,034,724 | 7/1991 | Tone | 340/571 |
| 5,053,749 | 10/1991 | Weiss | 340/568 |
| 5,053,750 | 10/1991 | Alex | 340/568 |
| 5,125,356 | 6/1992 | Galante | 116/200 |
| 5,204,657 | 4/1993 | Prosser | 340/568 |
| 5,272,319 | 12/1993 | Rey | 235/379 |
| 5,373,283 | 12/1994 | Maharshak | 340/568 |
| 5,396,218 | 3/1995 | Olah | 340/572 |
| 5,418,520 | 5/1995 | Hirshberg | 340/568 |
| 5,515,031 | 5/1996 | Pereira et al. | 340/568 |

*Primary Examiner*—Jeffery Hofsass
*Assistant Examiner*—Benjamin C. Lee
*Attorney, Agent, or Firm*—Paul J. Cook

[57] ABSTRACT

An alarm system is provided for a card shaped object comprising a holder for the card shaped object and a detecting apparatus for detecting the absence of the card shaped object from the holder and a device transmitter. The transmitter device sends a signal to a component remote from the holder and a transmitter device. The transmitter device sends a signal to a component remote from the holder which contains a receiver of the signal and an adjustable alarm. A resettable timer is positioned either in the holder or in the component remote from the holder so that, after a set time period, is activated in response to the signal.

32 Claims, 4 Drawing Sheets

ALARM FOR A CARD SHAPED OBJECT

BACKGROUND OF THE INVENTION

This invention relates to an alarm apparatus for card shaped objects such as a credit card or a driver's license. More particularly, this invention relates to an alarm apparatus to alert an owner of a card shaped object of its absence from a predetermined position for the object for a time period.

Occasionally, when using a card such as a credit card for a purchase or a driver's license for identification, the object is left by the object's owner in error such as in a store or the like. Such error can remain unnoticed for an extended period after the user of the card shaped object which can lead to difficulties in future unauthorized use of the card shaped object.

U.S. Pat. No. 3,959,789 discloses a credit alarm system for a plurality of cards which are positioned in a common card carrying case. The system includes a plurality of separators for holding cards, a switching means, a power source, a time delay means and an alarm.

U.S. Pat. No. 4,652,865 discloses an alarm system for a card holder which is to be positioned in a wallet or a handbag. The system includes a plurality of pockets, a magnet; a magnetic strip and an electrical circuit. The electrical circuit includes an electric cell, a timer, a starter to trigger and reset the timer and an indicator such as an alarm.

U.S. Pat. No. 4,584,571 discloses a portable alarm device for a bag or the like for preventing theft of an article from the bag. The alarm device includes a magnet attached to the article, a casing attached to the bag, at least two magnetic switches positioned in the casing which are serially connected to each other, a power source and a signalling device.

U.S. Pat. No. 4,620,183 discloses an alarm system for a jewelry display case which senses the removal of an article from the case.

Presently available alarm systems for a card incorporate the totality of the system components in the card holder. This results in an undesirable bulk of the wallet or purse or the like. In addition, particularly in the case of a wallet, the system can be damaged by the weight of the user when in a reclining position. Also, a small less bulky battery may not deliver sufficient amperage to produce a sufficient signal for an alarm positioned within a wallet or a purse.

Accordingly, it would be desirable to provide an alarm system for a card shaped object which alerts the owner of the object that it is missing. In addition, it would be desirable to provide such an alarm system which is capable of operating based upon a physical characteristic of the card like object and in the absence of human intervention other than normal use of the object.

SUMMARY OF THE INVENTION

The present invention provides an alarm system for a card shaped object comprising a holder for the card shaped object to position the card shaped object within a predetermined volume and an alarm apparatus which becomes activated when the card shaped object is removed from the holder. The card shaped object, hereinafter referred to as "card" is a thin hand holdable object which is formed from readily available materials such as impregnated or unimpregnated paper or cardboard, plastic compositions or the like, usually rectangular, with rounded corners, such as a credit card, driver's license, identification card, membership card, account card or the like which can fit into a wallet, purse or the like. The alarm system is a two component system. The first component comprises a holder for one or a plurality of cards and a powered transmitter means which transmits a signal when a card is removed from its holder or after a time period from the time the card is removed from its holder. The second component which is unattached from and remote from the first component comprises a receiver of the signal and alarm which is activated by the signal either by closing or opening an electrical circuit having a portable electrical voltage source. The alarm can be activated either when the signal is received or after a period of time from the time the signal is received. The alarm emits a discernable signal such as sound, light or a vibration. A resettable timer can be included in the first component only, the second component only or both the first and second component when it is desired to activate the receiver and/or transmitter means after the elapse of a preset time period. The second component containing the receiver and alarm can be located, for example, on a key ring, in a watch, the interior of an automobile such as the dashboard, or in a room of a building.

DESCRIPTION OF SPECIFIC EMBODIMENTS

Figure 1:
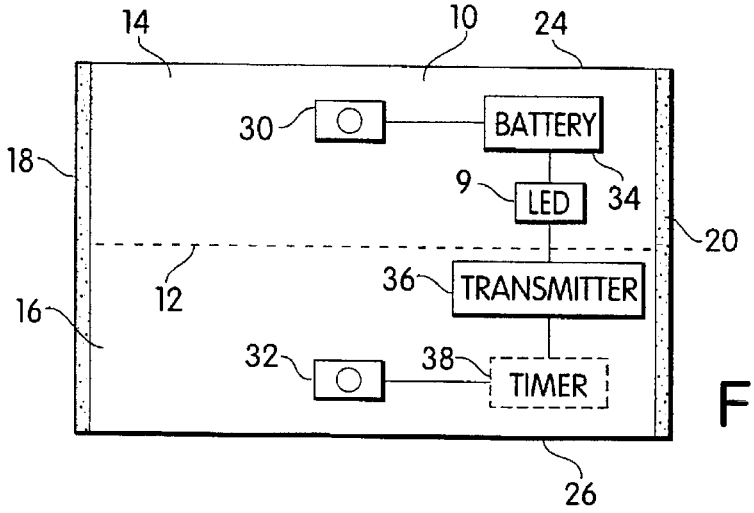
FIG. 1 is a circuit diagram of one embodiment of this invention utilizing a closed circuit to actuate a transmitter.
Figure 1A:
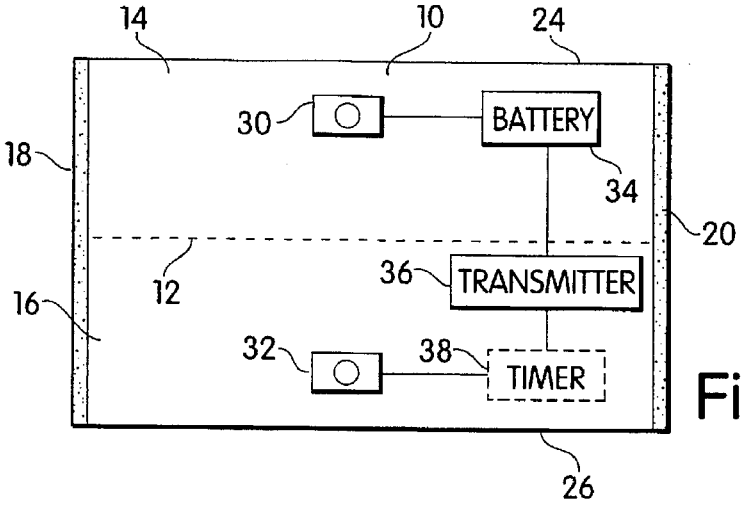

The present invention provides a two component alarm system for one or a plurality of cards such as a plastic credit card having a magnetic strip or a driver's license. A holder for a card or cards and a transmitter means are provided in one component and a means for receiving a signal from the transmitter and an alarm means are provided in a second component separate from and remote from the first component.

The card holder is shaped to position the card in a stationary position so that a portion of the card can complete or interrupt an electrical circuit within or on the card holder. The card holder can be in the form of a sleeve which substantially surrounds the periphery of the card while one surface is free so that the object can be easily removed from the holder such as by sliding it from the holder or grasping it to remove it from the holder. The peripheral surface of the card opposite the free surface or surface to be grasped is positioned within the holder so that the card interacts with an electrical circuit which includes a signal transmission means on or within the holder. When the card is removed from the holder it is removed from contact with any portion of the electrical circuit and the electrical circuit is activated by the object's removal. Activation can be effected by completing or opening the electrical circuit in the card holder which includes the transmitter.

The removal of the card like object from the card holder to activate or deactivate the electrical circuit can be effected by any physical characteristic of the card like object such as electrical resistance or conductivity of the object, magnetic characteristics of the object surface geometry of the object or the like. When the circuit is activated, a voltage variation is effected to cause current flow through a timer in the circuit. When a predetermined time has occurred from the initial time of activating circuit, the alarm is activated to produce a signal which can be readily observed such as sound, vibration and/or light to cause current flow to a transmitter in the circuit. Activation of the transmitter produces a pulsed code radio frequency signal which can be readily detected by a receiver in the remote second component containing a voltage source and an alarm. The pulsed code radio frequency transmitter emits a signal which is received by a receiver comprising a radio frequency receiver. The alarm emits a discernable signal such as sound, light or vibration.

A timer can be included with the circuitry of one or both components to provide a delay between the time the card or cards are removed from the card holder and the time the alarm is activated. The timer or timers can be preset to provide a desired delay. The timer or timers automatically reset to their original inactive setting after they have been activated, or rendered inactive by the insertion of the card.

The second component containing the signal receiver, power supply, e.g., battery and alarm in an electric circuit can be positioned on a portable item carried by the card holder, preferably, a portable item routinely carried by the card holder, such as a watch or a key ring. In this embodiment, it is preferred that a timer be positioned on the portable item so as to reduce the bulk of the first component in a wallet of a user.

The second component also can be positioned in a vehicle such as an automobile, or a boat or within a room such as in the home of the card holder. In this embodiment, the timer can be omitted from the circuitry of both components since the vehicle or room is generally remote from the point of card use and it is desirable that the user of the device be notified of the alarm as soon as possible. In addition, the distance of signal transmission from the transmitter is limited so that the alarm is not activated until the transmitter is near the receiver in the second component.

The transmitter and alarm can be coded when a plurality of cards are maintained in the card holder by the user. For example, the signal from the transmitter can be pulsed, e.g., two consecutive rapid pulses can indicate the card in "2" position in the holder is missing or three consecutive rapid pulses can indicate a card in a "3" position in the card holder is missing, etc.

When an electrical circuit is inactivated in the first component when the card is removed from the card holder, a switch can be activated to activate a second circuit which includes a power supply, an optional timer and the transmitter to be activated. The transmitter or timer and transmitter are activated to effect the function described above. Inactivation of the original circuit can be effected, for example, by small prongs formed of insulating material on one inner surface of the card holder which fit into depressions on one surface of the card while an electrically conductive card completes an electrical circuit while it is positioned within the card holder. When the card is removed from the card holder, electrically conductive means on opposite surfaces of the card holder no longer contact the electrically conductive card to form the circuit and the insulating prongs prevent contact of the conducting surfaces of the holder so that the circuit is inactivated. The inactivated circuit can be used to activate a second circuit by means of a switch. The second circuit includes the optional timer and the transmitter or transmitters which functions as set forth above.

An alternative first component embodiment of this invention utilizes a magnetic strip common in credit cards to activate an electrical circuit when it is removed from the card holder. The magnetic strip can activate the electrical circuit by means of movement of the magnetic strip past an electromagnetic pick-up device positioned in the card holder such as a microphonic device which would effect closing of a switch through a field effect transistor. (F.E.T.) in a circuit to activate the transmitter in the circuit. Repositioning the card in the holder causes an opening of the switch.

In another first component alternative embodiment, an electromagnetic card is activated when the card is removed from the card holder and the electromagnetic field between two electrodes in a capacitor changes by virtue of change in distance due to removal of the card from the space between the two capacitor electrodes. This distance difference is detected by a F.E.T. which closes a circuit to a battery, timer and a transmitter.

In another first component alternative embodiment, an electrical circuit is activated when an electrically insulating card is removed from the card holder. Electrically conductive means such as metals or conductive plastics previously separated by the card are free to contact each other to complete the circuit when the card is removed. The electrical circuit includes the power supply, e.g., battery, timer and alarm as described above.

In another embodiment, a card can be modified to carry a small electrical current which does not adversely affect information magnetically imprinted on a card. Such a modified card is useful in conjunction with an electrical circuit containing a low battery alarm.

The present invention will be described herein with reference to the accompanying drawings.

Figure 2:
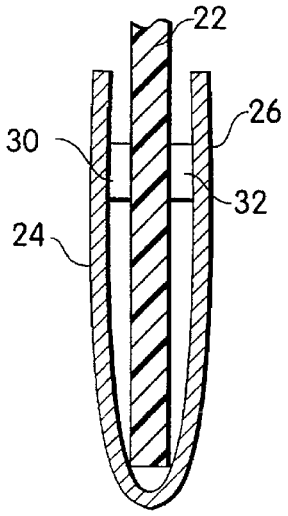
FIG. 2 is a cross-sectional side view of an embodiment of this invention.

Referring to FIGS. 1 and 2, the card holder 10 which is foldable along seam 12 and having complementary side 14 and 16 as well as 18 and 20 are sealed along the edges 18 and 20 in operative position to form the cardholder 10. As shown in FIG. 2, the card 22 is inserted into a space between card holder sections 24 and 26 in order to contact electrically conductive contacts 30 and 32. The card 22 is electrically insulative and nonconductive so that the card 22 functions as an insulator between electrically conductive elements 30 and 32. When the card 22 is removed from card holder 10, electrically conductive element 30 and 32 contact each other so that the circuit comprising contacts 30 and 32, power supply, e.g., battery 34, transmitter 36, light emitter diode 9 which light indicates the efficiency of the voltage source and optional timer 38 shown in dotted lines, cooperate to form an electrical circuit. The transmitter 36 and optional timer 38 can be integrated on a single chip or can be utilized separately. In any event, the transmitter 36 and light emitter diode 9 are activated when the card is removed from contact with strips 30 and 32. Typical timers 38 which can be utilized include monostable, multivibrator, or variable oscillators.

Figure 3:
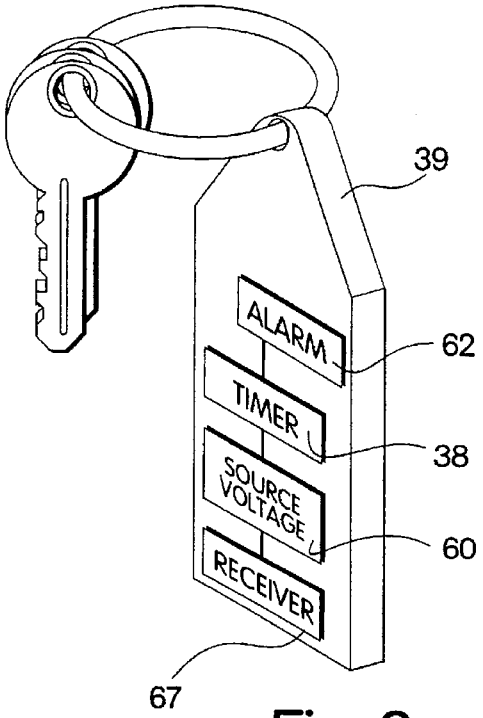
FIG. 3 is a circuit diagram of a remote component of the device shown in FIG. 1 utilizing a receiver and an alarm.

Referring to FIG. 3, the circuit on key ring 39 comprising a second component of this invention includes a voltage source 60, a radio frequency receiver 67, which receives a signal from the transmitter 36 in FIG. 1, activating an optional timer 38 or directly activating alarm 62. After a predetermined interval has elapsed, the timer 38 switches on the alarm 62 when the timer is utilized. Typical alarms 62 include vibrators such as micro motors, audio emitters such as piezoelectric buzzers or light emitters such as light emitting diodes.

Figure 4:
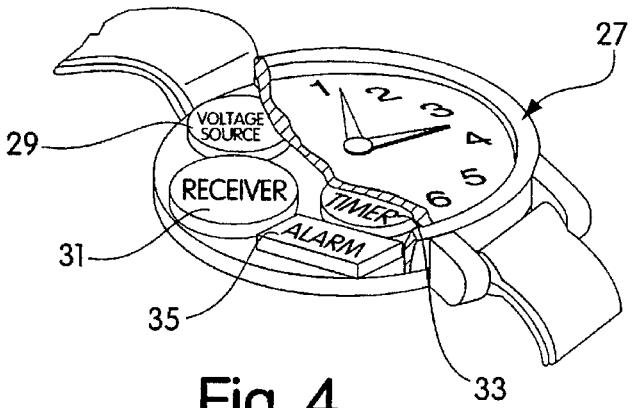
FIG. 4 is a partial cross-sectional view of a remote component of the device of this invention in a watch.

Referring to FIG. 4, a watch 27 comprising a second component of this invention includes a voltage source 29, a receiver 31, a timer 33 and an alarm 35.

Figure 5:
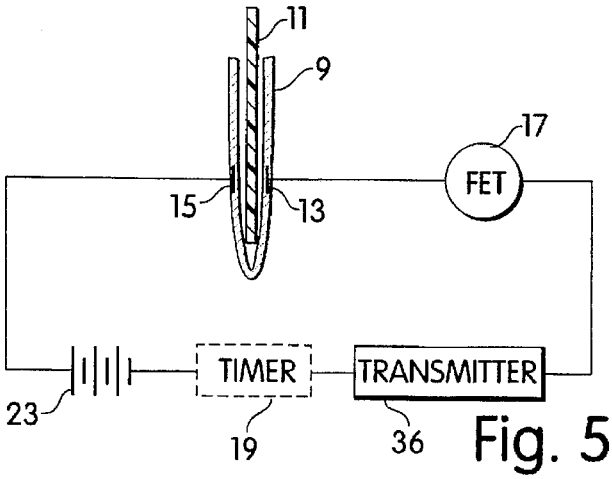
FIG. 5 is a circuit diagram of an alternative embodiment of this invention utilizing a capacitance means.

Referring to FIG. 5, the circuit includes a capacitor 9 within which card 11 fits. The capacitor 9 includes two electrodes 13 and 15. F.E.T. 17 is connected to capacitor 9 and is activated when card 11 is removed from capacitor 9 in the circuit include optional timer 19 and transmitter 37 or capacitor 9 to, in turn, activate transmitter 36 by means of battery 23. Transmitter 36 or timer 19 can also contain a low battery sensor.

Figure 6:
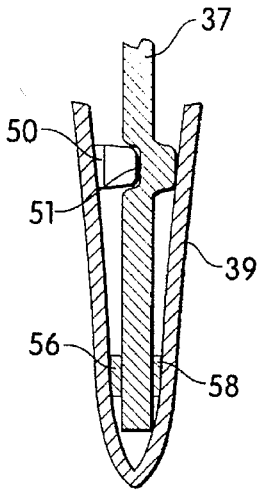
FIG. 6 is a cross-sectional view of an alternative embodiment of this invention.
Figure 7:
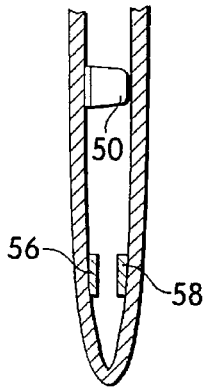
FIG. 7 is a cross-sectional view of an alternative embodiment of this invention.
Figure 8:
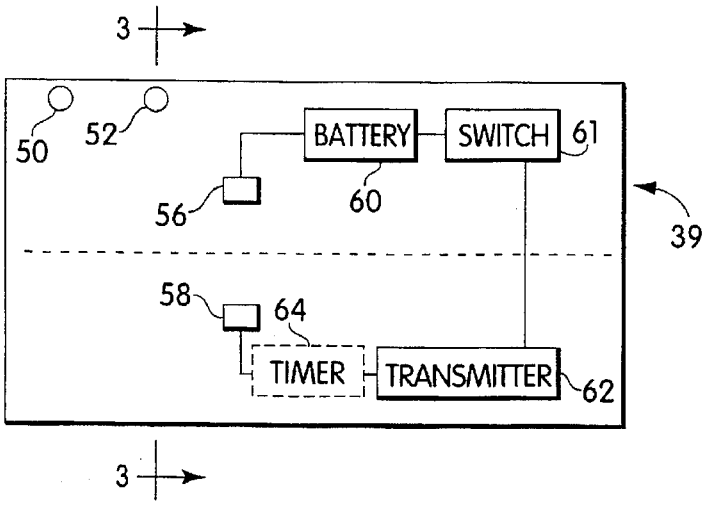
FIG. 8 is a circuit diagram which can be utilized with the embodiment of this invention.

Referring to FIGS. 6, 7 and 8, a circuit in active (FIG. 6) and passive (FIG. 7) positions is shown. The circuit takes advantage of depression areas in a credit card or the like which are used to identify the credit card number, the name of the card holder or the like on the credit card. The extensions 50 and/or 52 are utilized in conjunction with depressions in the credit card 37 to fit in card depressions 51. The card 37 fits into holder 39 and is electrically conductive so that an electrical connection is made between electrical contacts 56 and 58 to complete the circuit between power supply 60, optional timer 64 and transmitter 62 or directly to transmitter 62. Transmitter 62 will be activated as long as contacts 56 and 58 remain apart by means of prongs 50 and 52.

Figure 9:
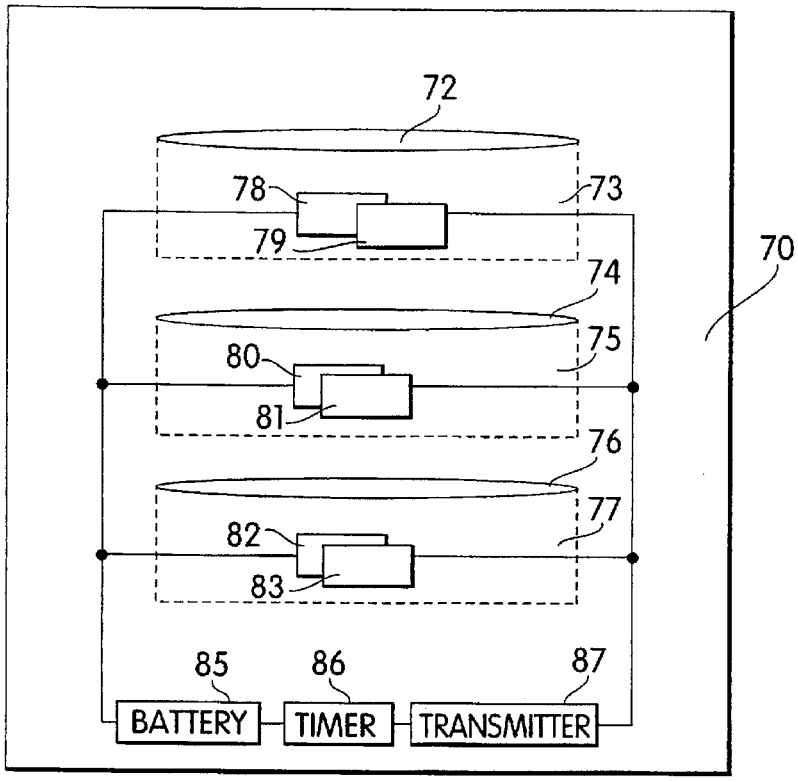
FIG. 9 illustrates an embodiment of this invention for a plurality of card-like objects.

Referring to FIG. 9, a card holder 70 includes a multiplicity of slots 72, 74 and 76 which are sized to hold one card like object. The circuit of FIG. 1 can be utilized in a card holder which holds two or more cards and the circuit can sense the removal of only one card. The holder 73 associated with slot 72 includes two electrical contacts 78 and 79 on opposing surfaces of the holder 73 such as is shown in FIG. 1. The holder 75 also includes two such electrical contacts 80 and 81. The holder 77 also includes two such electrical contacts 82 and 83. The circuits respectively including contacts 78 and 79; 80 and 81 as well as 82 and 83 are in parallel with each other and all include battery 85, optional timer 86 and transmitter 87. The transmitter is activated as described above when a card like object is removed from any of slots 72, 74 or 76. If desired an alarm apparatus comprising a timer, an alarm and a battery can be provided for each holder 73, 75 and 77. If desired, as set forth above, each slot 72, 74 and 76 can be coded so that the transmitter 87 transmits a different signal for each slot 72, 74 or 76 so that the user can identify the slot not containing a card.

Figure 10:
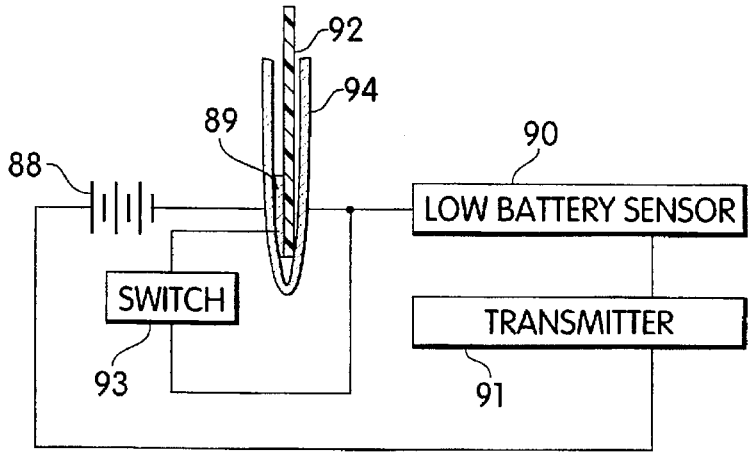
FIG. 10 illustrates an embodiment of this invention which utilizes a low battery alarm.

The circuit of FIG. 10 can be utilized in conjunction with a card capable of carrying a current. Conventional credit cards or driving licenses are formed from an insulating polymeric material. A magnetic strip, when utilized is formed from micromagnets suspended in an insulating matrix. The conventional information is imprinted in the magnetic strip by means of high gauss magnetic heads.

In the embodiment of this invention shown in FIG. 10, the magnetic strip can be capable of carrying a low current when the micromagnets are suspended in a conductive matrix such as graphite, which low current does not adversely affect the magnetically imprinted information. A second method for causing a card to carry a small current is to overcoat the magnetic strip or other portion of the card with a conductive non-magnetic metal such as high nickel stainless steel, gold alloy, copper or aluminum.

Referring to FIG. 10, the circuit includes a battery 88, a conducting magnetic strip 89, a low battery sensor 90 such as a zenar diode and a transmitter 91. The transmitter 91 and battery sensor 90 is activated when card 92 is removed from conducting magnetic strip 89. The inactivated circuit can be used to activate a second circuit by means of a switch 93.

I claim:

1. A two component alarm system to identify removal of a card from a holder for the card which comprises:

a) a first component comprising a holder having a housing for a card, means for sensing removal of said card from said housing, a voltage source and a transmitter for transmitting a first signal to a remote location connected in a first electrical circuit, and b) a second component at said remote location comprising a receiver of said first signal transmitted by said transmitter, a voltage source, and an alarm being connected in a second electrical circuit separate from said first electrical circuit, said alarm being activated after said card is removed from said housing and in response to said first signal and said alarm emitting a second discernable signal.

2. An alarm system to identify removal of a card from a holder for the card which comprises:

a) a first component comprising a holder having a plurality of card housings, means for sensing removal of said card from said housing, a voltage source and a transmitter for transmitting a first signal to a remote location connected in a first electrical circuit, each of said to a remote location connected in a first electrical circuit, each of said housings sized to accommodate a card, and b) a second component at said remote location comprising a receiver of a first signal transmitted by said transmitter, a voltage source, and an alarm connected in second electrical circuit separate from said first electrical circuit, said alarm being activated after a card is removed from at least one of said housings and in response to said first signal and said alarm emitting a second discernable signal.

3. The system of any one of claims 1 or 2 wherein said first circuit includes a timer.

4. The system of any one of claims 1 or 2 wherein said second circuit includes a timer.

5. The system of any one of claims 1 or 2 wherein said first circuit and said second circuit each include a timer.

6. The system of any one of claims 1 or 2 wherein said alarm system is activated when an electrical circuit is completed by removal of a card from said housing.

7. The system of claim 6 wherein said first circuit includes a timer.

8. The system of claim 6 wherein said second circuit includes a timer.

9. The system of any one of claims 1 or 2 wherein said alarm system is activated when an electrical circuit is opened by removal of a card.

10. The system of claim 9 wherein said first circuit includes a timer.

11. The system of claim 9 wherein said second circuit includes a timer.

12. The system of any one of claims 1 or 2 wherein said card is electrically nonconductive.

13. The system of claim 12 wherein said first circuit includes a timer.

14. The system of claim 12 wherein said second circuit includes a timer.

15. The system of any one of claims 1 or 2 wherein said card is electrically conductive.

16. The system of claim 15 wherein said first circuit includes a timer.

17. The system of claim 15 wherein said second circuit includes a timer.

18. The system of any one of claims 1 or 2 wherein said card includes a magnetic strip which causes an electrical circuit to activate.

19. The system of claim 18 wherein said first circuit includes a timer.

20. The system of claim 18 wherein said second circuit includes a timer.

21. The system of any one of claims 1 or 2 wherein said second component is positioned within a watch housing.

22. The system of claim 21 wherein said first circuit includes a timer.

23. The system of claim 21 wherein said second circuit includes a timer.

24. The system of any one of claims 1 or 2 wherein said second component is positioned on a ring sized to fit within a clothing pocket.

25. The system of claim 24 wherein said first circuit includes a timer.

26. The system of claim 24 wherein said second circuit includes a timer.

27. The system of any one of claims 1 or 2 wherein said second component is positioned within a vehicle.

28. The system of claim 27 wherein said first circuit includes a timer.

29. The system of claim 27 wherein said second circuit includes a timer.

30. The system of any one of claims 1 or 2 wherein said second component is positioned within a building.

31. The system of claim 30 wherein said first circuit includes a timer.

32. The system of claim 30 wherein said second circuit includes a timer.

* * * * *